US005255456A

United States Patent [19]

Franklin

[11] Patent Number: 5,255,456

[45] Date of Patent: Oct. 26, 1993

[54] DOUBLE LAYER CARD

[76] Inventor: Roger Franklin, 237 Mamaroneck Ave., White Plains, N.Y. 10605-1377

[21] Appl. No.: 173,431

[22] Filed: Mar. 25, 1988

[51] Int. Cl.[5] ..... G09F 1/00

[52] U.S. Cl. ..... 40/124.1; 229/92.8

[58] Field of Search ..... 40/124.1, 312, 360; 283/56, 1 B, 103, 105, 101; 273/139; 229/92.8

[56] References Cited

U.S. PATENT DOCUMENTS 2,321,184 6/1943 Butterworth ..... 283/101
2,363,472 11/1944 Ritter ..... 229/92.8
2,805,816 9/1957 Morgan ..... 40/299
3,956,049 5/1976 Johnsen ..... 283/103
4,318,235 3/1982 Augeri ..... 40/310
4,619,457 10/1986 Small ..... 283/56
4,705,301 11/1987 Dojel ..... 283/105
4,892,246 1/1990 Norman ..... 229/92.8

*Primary Examiner*—Cary E. O'Connor
*Attorney, Agent, or Firm*—Handal & Morofsky

[57] ABSTRACT

A double layer advertising piece which can be separate to remove some of the printed advertising to create a postal reply card for use by the consumer.

18 Claims, 1 Drawing Sheet

DOUBLE LAYER CARD

TECHNICAL FIELD

The present invention relates to a double layer card of particular utility in the areas of advertising and promotion. The advertising piece, a double layer card, may be bound into a book or magazine, or function as a free-standing advertisement.

BACKGROUND OF THE INVENTION

In recent years, the volume of print advertising to which the public is exposed has grown enormously. Boundless resources and ingenuity have been devoted to the goal of differentiating one advertising piece from others that compete for the attention of the same intended customer. In a society where thousands or even millions of copies of an advertising piece are printed and distributed to would-be readers, an invention that increases even slightly the percentage of readers who read it or respond to it is of value and utility.

One popular advertising device is the familiar postal reply card. A postal reply card can be used as an independent advertising piece, for example as part of a cooperative mailing program or can be bound or "blown" loose into a book or magazine, where it remains until the reader picks up the magazine and turns the pages. The average consumer is exposed o a multiplicity of such cards, diminishing the likelihood that each card will receive the full and undivided attention of the reader.

Another device described in U.S. Pat. No. 1,957,374 of Unger is a two-layer advertising mailer bearing the address of the recipient, comprising a separate ink blotting layer securedto a backing layer. In that device which is mailed to the consumer, the backing blotter layer is perforated with the intention that one may remove and return a preaddressed business reply card leaving the advertising ink blotter in the hands of the consumer.

Other double layer advertising devices are known but the perforated area as shown in U.S. Pat. No. 1,957,374 have had square corners. Experience shows that perforated areas with square corners cannot be easily removed in a reliable way without unwanted tearing of the material which makes them unsightly and difficult to use or retain. This is a particular problem when the double layer card is designed for use as reply post card and must remain intact once the area is removed.

It is an object of the present invention to provide a novel double layer card useful as an advertising piece that has an improved likelihood of receiving the attention of the reader and yields an easily removable postal reply card suitable for mailing.

SUMMARY OF THE INVENTION

The invention is a double layer card, having a front card and a rear card joined at the perimeter, the front card having a removable printed flap which covers printed areas on the rear card below it. The front card has perforations in the unjoined area defining a removable flap with a rounded corner. The flap has at least one rounded corner in order that it may be easily removed from the front card to reveal the printed areas on the rear card and the back of the flap. The front and rear cards are preferably joined by being glued together at the perimeter only allowing the flap to be easily removed from the front card without tearing. In the preferred embodiment after the flap is removed the uncovered rear card forms a postal reply card which is preaddressed on the backside. The printed flap once removed can be discarded or retained by the user depending on the nature of the message or information on the flap.

In a preferred embodiment, printed information on the front card of the double layer card and the removable flap urges the reader to remove the perforated flap. Ideally the reader becomes curious as to what is under the flap, and since no cost and little effort are involved, the reader may proceed to do so. The printed information revealed upon removal of the flap ideally receives more attention than it would if it had been visible from the outset, giving rise to a better response rate than conventional advertising cards. The removable flap may also be printed with useful information which the user might retain and serve as a continuing reminder of the advertisement or the product. The uncovered rear card serves as the reply card with a place, usually under the flap, for the consumer's name and address and preaddressed with the advertiser's address on the backside of the rear card.

DETAILED DESCRIPTION OF THE INVENTION

Figure 1:
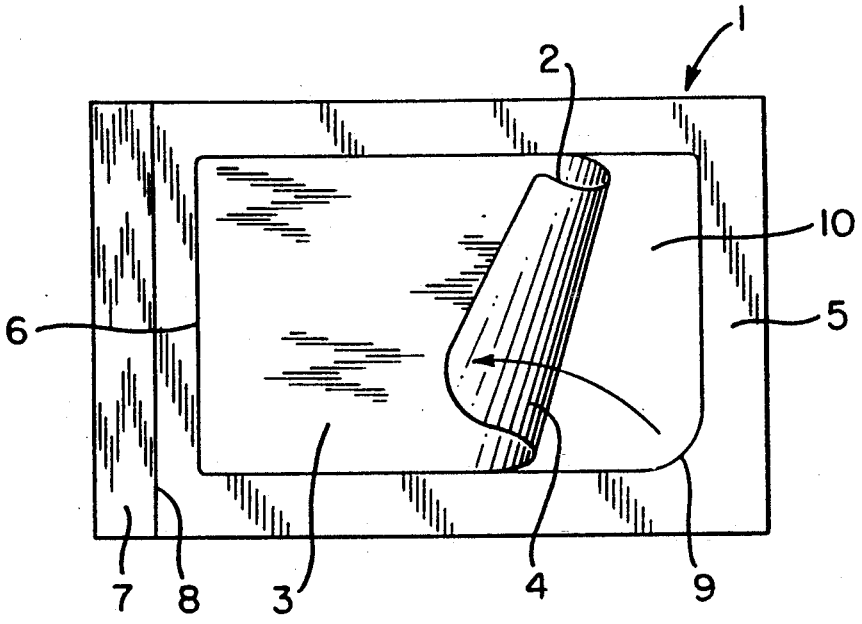
FIG. 1 shows the double layer card of the invention, with the flap partially removed.

The invention will now be described in more detail with specific reference to FIGS. 1–2.

The double layer card 1 comprises a front card **1*b* and a rear card 1*a* preferably attached by gluing or stapling together at the perimeter to form the double layer card 1. On the front card 1*b* there is an unattached area 3 and attached margin area 5. Also provided on the front card is a perforated flap 2 with at least one rounded corner 9, shown partially removed, which may be easily removed in its entirety without tearing to reveal unglued area 10 on the rear card 1*a*** where more information may be printed.

As can be seen from FIG. 1, the perforated flap 2, when removed, has on its reverse side an additional area 4 where still more information may be printed.

Flap 2 is removable from the unattached area 10 of the rear card because of perforation 6, which in the figure is shown as a substantially rectangular perforation having a rounded area at lower right corner 9, and provides a convenient and easy means to remove perforated flap 2. The rounded corner 9 is preferably die cut and may further optionally represent a large continuously die cut region on the front card **1*b*, which construction allows the user to employ a fingernail or letter opener to further loosen and remove the flap and expose area 10**.

Figure 2:
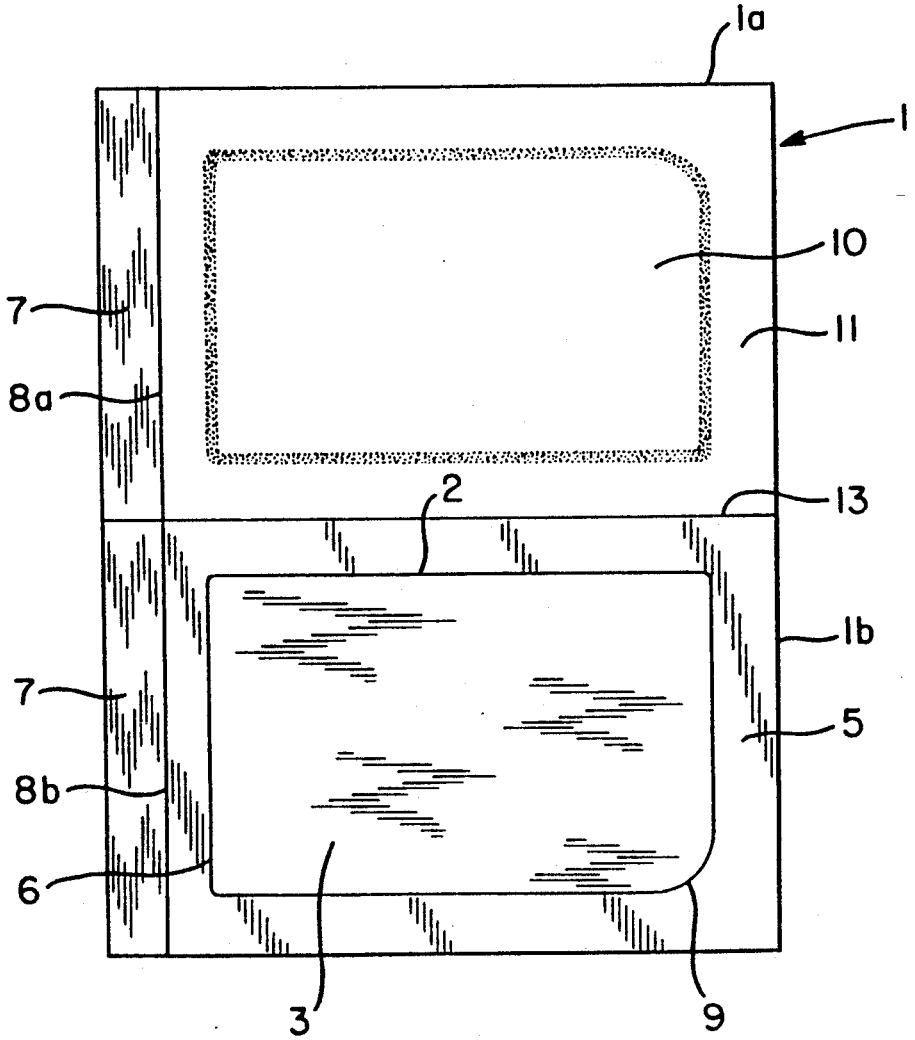
FIG. 2 shows the rear and front card in the preferred embodiment prior to folding.

The double layer card 1 is composed of a rear card **1*a* and a front card 1*b*, shown in FIG. 2 as a single piece. FIG. 2 shows the preferred embodiment with the rear card, and the front card of the double card of FIG. 1, prior to folding along line 13 and gluing around the perimeter to form the double layer card 1. Perforation 6 defines flap 2 which, when removed, leaves a margin area 5**.

In the manufacture of the invention, cards 1*a* and 1*b* are preferably prepared and printed as one single piece which is folded to form the double layer card. Glue is applied to the area 11 of rear card 1*a*, as shown in FIG. 2. Alternatively, the glue may be applied to the back of the margin 5 on the front card. The printed card is folded so that the front card 1*b* is placed in contact with rear card 1*a* and the glue is allowed to set. In the preferred embodiment the piece is printed, glued and folded all in one machine step.

Optionally an additional perforation 8 may be provided on the double layer card as shown in FIGS. 1 and 2 defining a tab 7 which may be bound into a book or magazine. Perforation 8, may be made after the front card and rear card are attached to each other but preferably the perforation 8*a* may be made on the unfolded piece as shown in FIG. 2, defining tab 7. The reader removes the bound double layer card 1 from the book or magazine binding by tearing perforation 8, leaving tab 7 bound in place in the book or magazine.

In the preferred embodiment the back side of rear card 1*a* may be printed to form the preaddressed side of a standard postal reply card. After the flap 2 has been removed and the message read, the reader may conveniently fill in a name and address and mail the card to obtain additional information or make a purchase or obtain merchandise. The card stock used in making the double layer card as well as the stiffness, thickness, dimensions may vary depending on the use to which the card will be put. If the card is to function as a postal reply card the card stock and address printing are selected so as to satisfy postal service requirements. For example, a preprinted bar code may appear below the address lines, and an FIM (facing identification mark) may appear at the upper edge of the address side, in keeping with postal service guidelines. Ideally, space is provided in area 10 where the reader may write a name, address, or other information once the flap is removed.

The shape of flap 2, and of areas 3, 4, 5, 10, and 11, are all determined by the shape of perforation 6 and rounded corner 9. In FIGS. 1–2 the perforation is shown as basically rectangular with a rounded area at 9, giving rise to a basically rectangular flap 2 and areas 3, 4, and 10, and leaving corresponding areas 5 and 11 of substantially constant width. The double layer card can have a wide variety of shapes for perforation 6, and thus for areas 3, 4, 5, 10, and 11. Perforation 6 may, for example, be round, oval, or irregular, provided that a rounded preferably die cut corner 9 is used to insure ease of removal of the flap without tearing.

I claim:

1. A double layer card comprising a printed front card and a rear card printed on both sides and each having top and side edges, said cards joined at the top and side edges, said front card having a removable printed perforated flap in the unjoined area, said printed perforated flap including at least one rounded continuously cut corner so as to permit easy removal of said perforated flap from the front card to reveal at least a portion of the printed rear card which is a postal reply card.

2. An advertising device, comprising:

(a) a printed front card having a front side and bottom, top and side edges, and having printing disposed on said front side of said front card;

(b) a rear card having front and reverse sides, and bottom, top and side edges and printed on said front and reverse sides with information bearing indicia;

(c) said front card and said rear card being joined to each other along said bottom, top and side edges;

(d) a flap defined in said front card by a plurality of perforations, said perforations being defined by said front card in positions on said front card which are not joined to said rear card; and (e) a continuous cut in said front card, said cut being positioned to meet said perforations, said continuous cut and said perforations defining a substantially closed two-dimensional shape, said continuous cut being long enough to enable a use to engage a portion of said flap adjacent said cut and pull said flap to tear said perforations and permit easy removal of said flap.

3. An advertising device as in claim 2, wherein said front card is glued to said rear card and forms a unitary member therewith.

4. An advertising device as in claim 3, further comprising a multiple page publication with a spine wherein said unitary member defines additional perforations wherein perforations extend from the top to the bottom of said unitary member, wherein the area defined by said two-dimensional shape is on one side of said additional perforations, and wherein the portion of said unitary member on the side of said additional perforations opposite said flap is secured to said spine of said multiple page publication.

5. An advertising device as in claim 4, wherein said printing on the rear of said rear card is an address, whereby said rear card functions as a return postcard.

6. An advertising device as in claim 2, wherein said front and rear cards form a unitary member having a top and bottom and further comprising a multiple page publication with a spine wherein said unitary member defines additional perforations extending from the top to the bottom of said unitary member and wherein the area defined by said two-dimensional shape is on one side of said additional perforations, and wherein the portion of said unitary member on the side of said additional perforations opposite said flap is secured to the spine of said multiple page publication.

7. An advertising device as in claim 2, wherein said continuous edge forms a rounded corner.

8. An advertising device, comprising:

(a) a printed front card having a front side and a front card peripheral edge, and having printing disposed on said front side of said front card;

(b) a rear card having front and reverse sides, and a rear card peripheral edge and printed on said front and reverse sides with information bearing indicia;

(c) said front card and said rear card being joined to each other along at least a portion of their peripheral edges to form a unitary member;

(d) a flap defined in said front card by a plurality of perforations, said perforations being defined by said front card;

(e) a continuous edge defined by said front card, said continuous edge being positioned to meet said perforations, said continuous edge and said perforations defining a substantially closed two-dimensional shape, said continuous edge being long enough to enable a use to engage a portion of said flap adjacent said edge and pull said flap to tear said perforations and permit easy removal of said flap; and (f) a publication comprising a plurality of pages arranged as a unitary whole, said unitary member being positioned between two adjacent pages of said publication.

9. An advertising device as in claim 8, wherein said front card is glued to said rear card to form said unitary member therewith.

10. An advertising device as in claim 9, wherein said unitary member defines additional perforations extending from the top to the bottom of said unitary member and wherein the area defined by said two-dimensional shape is on one side of said additional perforations, and wherein the portion of said unitary member on the side of said additional perforations opposite said flap is secured to a spine of said multiple page publication.

11. An advertising device as in claim 8, wherein said unitary member defines additional perforations extending from the top to the bottom of said unitary member and wherein the area defined by said two-dimensional shape is on one side of said additional perforations, and wherein the portion of said unitary member on the side of said additional perforations opposite said flap is secured to a spine of said multiple page publication.

12. An advertising device as in claim 8, wherein said printing on the rear of said rear card is an address, whereby said rear card functions as a return postcard.

13. An advertising device as in claim 8, wherein said continuous edge forms a rounded corner.

14. An advertising device as in claim 8, wherein said cards are made of cardboard;

15. An advertising device as in claim 8, wherein said continuous edge is rounded.

16. An advertising device, comprising:

(a) a printed front card having a front side and a front card peripheral edge, and having printing disposed on said front side of said front card;

(b) a rear card having front and reverse sides, and a rear card peripheral edge and printed on said front and reverse sides with information bearing indicia;

(c) said front card and said rear card being joined to each other along at least a portion of their peripheral edges to form a unitary member;

(d) a flap defined in said front card by a plurality of perforations; and (e) said perforations defining a substantially closed two-dimensional shape, at least a portion of said two-dimensional shape being curved to enable a user to engage a portion of said flap adjacent said curved portion of said shape and pull said flap to tear said perforations and permit easy removal of said flap.

17. An advertising device as in claim 16, further comprising:

(f) a publication comprising a plurality of pages arranged as a unitary whole, said unitary member being positioned between two adjacent pages of said publication.

18. The card as described in claim 1, wherein a second perforation forms a tab for removal of the card after it has been bound into a book or magazine.

* * * * *